US005924378A

United States Patent [19]

Peterson et al.

[11] Patent Number: 5,924,378

[45] Date of Patent: Jul. 20, 1999

[54] TROLLING PLATE ASSEMBLY

[76] Inventors: Mark G. Peterson, 1691 Russet Dr., Eugene, Oreg. 97401; Leif S. Peterson, 975 Lafayette St., Denver, Colo. 80218

[21] Appl. No.: 09/205,507

[22] Filed: Dec. 4, 1998

Related U.S. Application Data

[51] Int. Cl.[6] ..... B63H 25/44

[52] U.S. Cl. ..... 114/145 A

[58] Field of Search ..... 114/145 R, 145 A, 114/270; 440/900; D12/317

[56] References Cited

U.S. PATENT DOCUMENTS

| | | | |
|---|---|---|---|
| 2,719,503 | 10/1955 | Smith | 114/145 A |
| 3,965,838 | 6/1976 | Uht . | |
| 4,549,498 | 10/1985 | Meyer et al. | 114/145 A |
| 5,005,507 | 4/1991 | Dyer . | |
| 5,070,803 | 12/1991 | Smith . | |
| 5,127,353 | 7/1992 | Wieser . | |
| 5,421,279 | 6/1995 | Loaks . | |
| 5,493,990 | 2/1996 | Dyer . | |
| 5,711,241 | 1/1998 | Dyer . | |
| 5,715,768 | 2/1998 | Anderson | 114/145 A |

*Primary Examiner*—Ed L. Swinehart

*Attorney, Agent, or Firm*—Robert E. Howard

[57] ABSTRACT

A trolling plate assembly for mounting on the motor of a small boat. The trolling plate assembly has a mounting bracket comprised of a flat plate with flanges extending upwardly from, and perpendicular to, the longitudinal edges of the plate. A fixed axle extends between the flanges. A movable locking rod extends between the flanges forward of the axle and parallel thereto. An outer, frame plate has cam ears located at one end thereof. The cam ears are pivotally attached to the axle. A trigger plate is positioned inwardly of the frame plate and has cam ears pivotally attached to the axle. The locking rod is urged by spring means toward the axle and into compressive contact with the outer surfaces of the cam ears of the frame and trigger plates. In a non-trolling position, the locking rod is seated in non-trolling recesses located on the outer surface of the cam ears of the frame plate to thereby lock the frame plate in a substantially horizontal position. When the motor is placed into reverse, the boat backs up and the pressure of the water acting against the trigger plate causes the cam ears of the trigger plate to rotate against the rod and move it out of locking engagement with the non-trolling recesses in the cam ears of the frame plate. Trolling spring members attaching the frame plate to the mounting bracket cause the frame plate and trigger plate to descend into a substantially vertical, trolling position.

9 Claims, 5 Drawing Sheets

TROLLING PLATE ASSEMBLY

BACKGROUND OF THE INVENTION

This invention relates to a trolling plate assembly for small boats.

Small boats, powered either by an outboard motor or an inboard/outboard motor, are used for numerous recreational purposes. For some recreational purposes the boat is powered up to run at high speeds, such as for water skiing or cruising. For other recreational purposes, such as fishing, it is desirable to be able to run the boat at low (trolling) speeds. It is sometimes difficult or impossible to run boats at a desired trolling speed since such trolling speed may be below the motor's recommended minimum idling RPM. Because of this difficulty, trolling (deflector) plates have been devised for mounting on the anticavitation plate of the boat's motor. Such trolling plates extend down into a position behind the motor's propeller and slows the velocity of the boat while the propeller is operating at its idle RPM.

Trolling plates currently in use are required to be manually moved between a horizontal, non-trolling position and a substantially vertical, trolling position, since the trolling plate is typically locked in its trolling or non-trolling position. See, for example, U.S. Pat. No. 3,965,838. The unlocking of the trolling plate for movement to a new position is typically accomplished by use of lanyards attached to the locking mechanism of the trolling plate assembly. If the boater forgets to unlock the trolling plate while it is in the trolling position, and accelerates the boat to a higher speed, the trolling plate can be damaged or destroyed.

It is an object of this invention to provide a trolling plate assembly that allows the trolling plate to be deployed to a trolling position and retracted to a non-trolling position without the use of lanyards. It is another object of this invention to provide a trolling plate that automatically retracts to a non-trolling position from a trolling position upon acceleration of the boat to a higher speed.

SUMMARY OF THE INVENTION

The trolling assembly of this invention is comprised of a mounting bracket, an outer (frame) plate and a smaller, inner (trigger) plate. The frame plate and trigger plate are each being pivotally attached through cam ears located at a first end thereof to a fixed axle located at the rearward end of the mounting bracket. The frame plate has heavy duty springs extending from the frame plate to the mounting bracket. The heavy duty springs are configured to constantly pull the plate downward toward a vertical, trolling position. The cam ears of the frame plate and trigger plate all abut against a movable locking rod that is parallel to the fixed axle and is constantly urged toward the fixed axle and held in abutment with the notched cam ears by spring members extending between the fixed axle and the locking rod.

When the boat is in a non-trolling, i.e., high speed mode, the frame plate is held in a substantially horizontal position by the locking rod, which is seated in a non-trolling recess located in the frame surface of the cam ears of the frame plate.

In the non-trolling mode the trigger plate moves freely about the fixed axis, but is held in a substantially horizontal position by the pressure of the locking rod pushing against the outer surface of the cam ears and by the pressure of water pushing against the inner (forward) planar surface thereof.

Thus, with the frame plate locked in the horizontal position by the locking rod, and the freely moving trigger plate also held in a substantially horizontal position by the forces described, there is no drag on the boat at high speed.

If it is desired to place the boat in a trolling mode, the boat is first slowed to idling speed. At idling speed, the frame plate is still in a substantially horizontal position, held there by the locking rod. The trigger plate, which is freely movable about the fixed axis except for the pressure of the locking bar against its notched cam ears, hangs down at a small angle to the horizontal.

The motor is then shifted into reverse to back the boat up. As the boat backs up, the trigger plate is forced downwardly by water pushing against its outer (rearward) planar face. As the trigger plate moves downwardly, its notched cam ears rotate against the locking rod, forcing it outwardly against the action of the springs urging it toward the fixed axle. As the locking rod moves outwardly, it moves out of engagement with the non-trolling recess located in the outer surface of the cam ears of the frame plate and the heavy duty springs extending between the frame plate and the mounting bracket force the frame plate downwardly into a substantially vertical position. As the frame plate and trigger plate approach a substantially vertical position, the locking rod seats in trolling notches on the cam ears of the frame plate and trigger plate to prevent them from proceeding further around and into contact with the closely adjacent propeller of the boat's motor. Once the frame and trolling plates have been deployed to their trolling position, the motor is placed in its forward (drive) position and set at its idling speed for trolling.

If it is desired to change from a trolling mode to a non-trolling mode, the boat's operator merely accelerates the motor to increase the speed of the boat. As speed increases, water pressing against the inner (forward) planar faces of the frame and trigger plates force them to rotate upwardly toward a horizontal position. As the frame plate achieves a substantially horizontal position, the locking rod seats in the non-trolling notch of the notched cam ears of the frame plate, and prevents it from moving downward.

DESCRIPTION OF PREFERRED EMBODIMENTS

Figure 1:
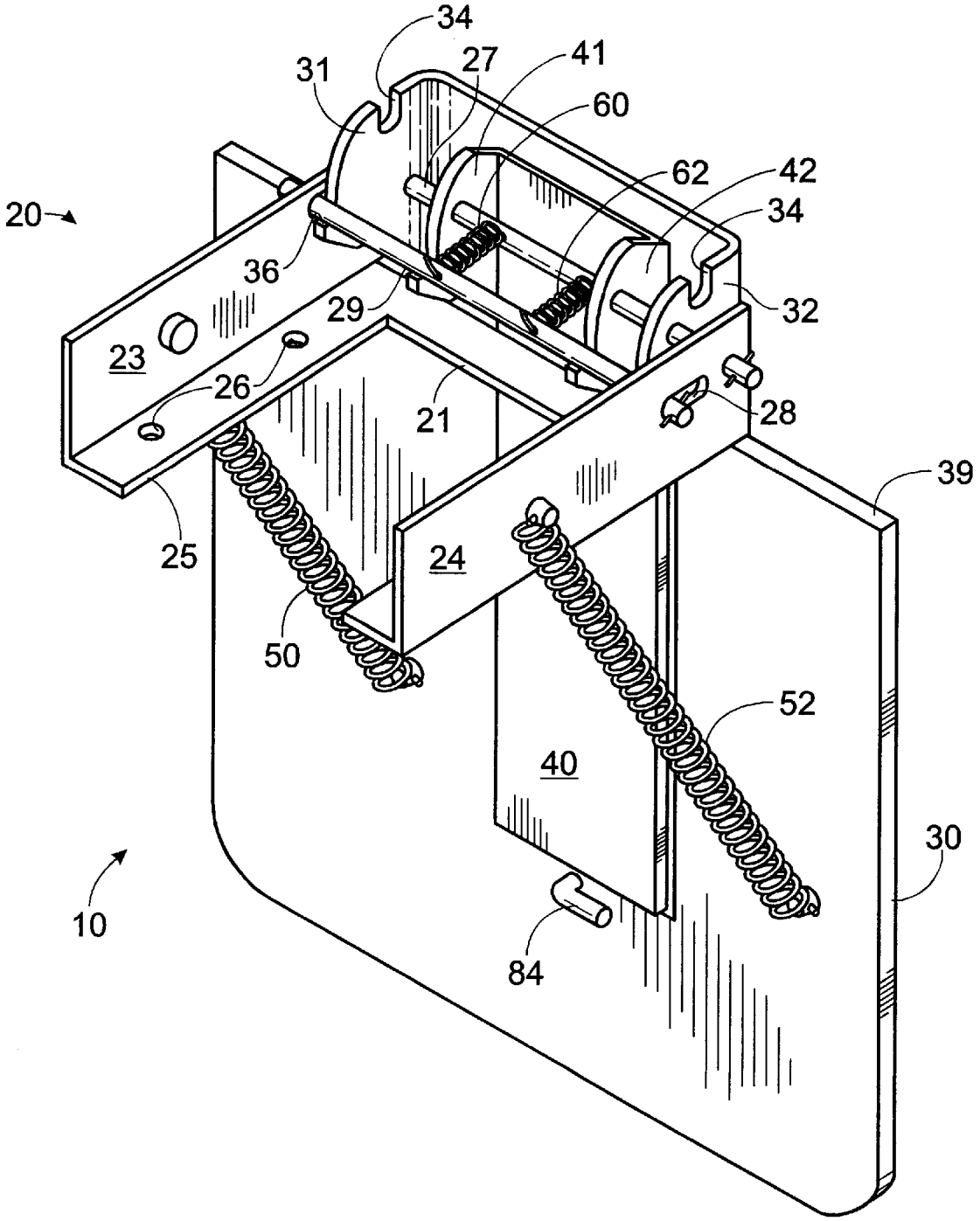
FIG. 1 is a perspective view of the trolling plate assembly of the present invention.

Trolling plate assembly 10 is generally comprised of a mounting bracket 20 to which is pivotally attached an outer (frame) plate 30 and an inner (trigger) plate 40.

Mounting bracket 20 is comprised of a horizontal plate member 21, integrally attached side flanges 23 and 24 extending upwardly from the longitudinal edges of plate 21, a central recess 25 located in plate 21, and a plurality of fastener receiving holes 26 in plate 21.

A fixed axle 27 is located in the rearward portion of bracket 20, and is secured to, and perpendicular to, flanges 23 and 24. Fixed axle 27 may be secured to flanges 23 and 24 by any suitable means, such as by welding or cotter pins located in the outer ends thereof.

Locking rod 29 extends through slots 28 located in flanges 23 and 24. Locking rod 29 is located forward of, and parallel to, fixed axle 27.

Frame plate 30 has notched cam ears 31 and 32 integral therewith and located at the forward end thereof, as best seen by reference to FIGS. 1, 2, 4, and 5. Cam ears 31 and 32 extend perpendicularly outward (downward) from major planar face 37 of frame plate 30. Holes 33 in each cam ear 31 and 32 rotatably receive fixed axle 27 therethrough.

Cam ears 31 and 32 are located on a narrowed forward portion of frame plate 30, the narrowed and wider portions of frame plate 30 being joined at shoulder 39.

Figure 4:
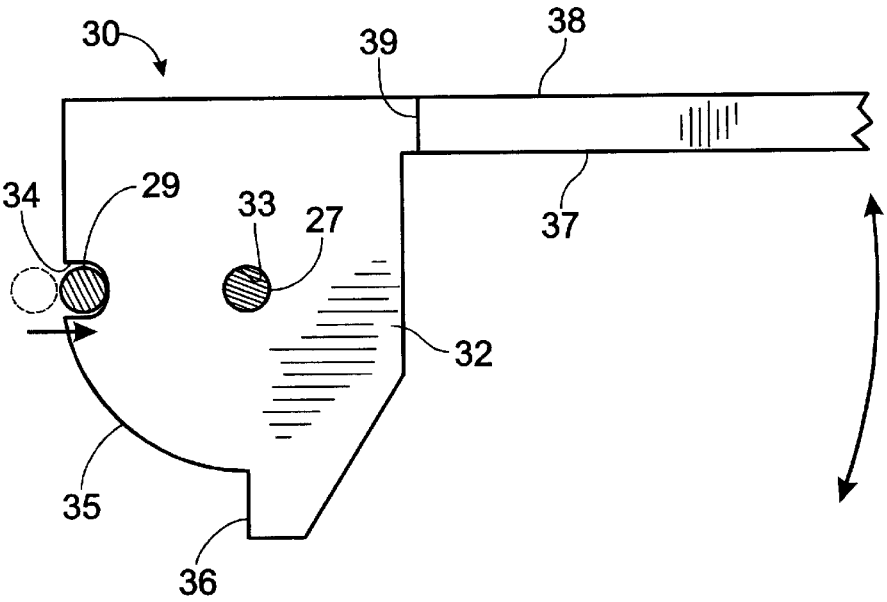
FIG. 4 is a fragmentary, side elevation view of one of the cam ears of the frame plate of the invention, shown in the non-trolling mode.
Figure 5:
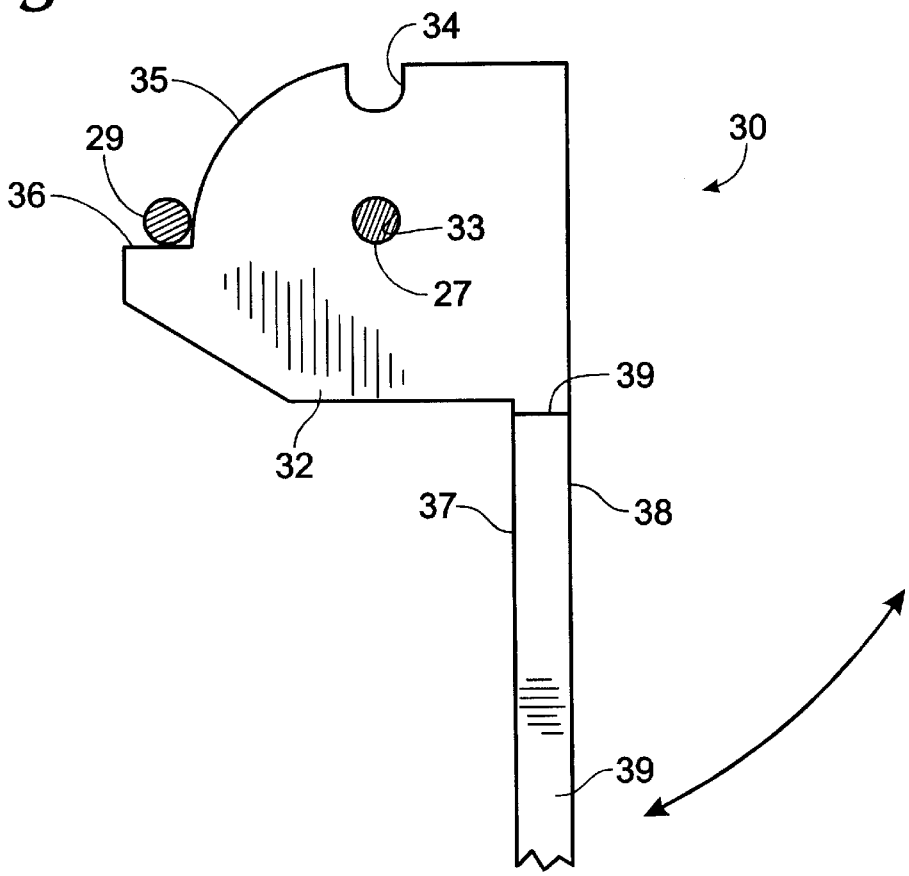
FIG. 5 is a fragmentary, side elevation view of one of the cam ears of the frame plate of the invention, shown in the trolling mode.

The relationship of the cam ears 31 and 32 of frame plate 30, fixed axle 27, and locking rod 29 is best seen in FIGS. 4 and 5. Only left cam ear 32 is shown, but right cam ear 31 is identical thereto, although the mirror image thereof.

FIG. 4 illustrates frame plate 30 in its substantially horizontal, non-trolling position. In this position, locking rod 29 is seated in non-trolling recess 34 located in the outer surface 35 of cam ear 32, and thus prevents frame plate 30 from moving from its substantially horizontal position.

FIG. 5 illustrates frame plate 30 in its substantially vertical, trolling position. In this position, cam ear 32 has rotated approximately 90 degrees from its non-trolling position shown in FIG. 4. As can be seen, the face of trolling notch 36 located in the outer surface 35 of cam ear 31 has come into contact with locking rod 29, thus preventing further clockwise rotation of frame plate 30.

Trigger plate 40 has notched cam ears 41 and 42 integral therewith and located at the forward end thereof. Cam ears 41 and 42 extend perpendicularly outward (downward) from major planar face 47 of trigger plate 40. Holes 43 in each cam ear 41 and 42 rotatably receive fixed axle 27 therethrough.

Cam ears 41 and 42 are located on the forward portion of trigger plate 40.

Figure 6:
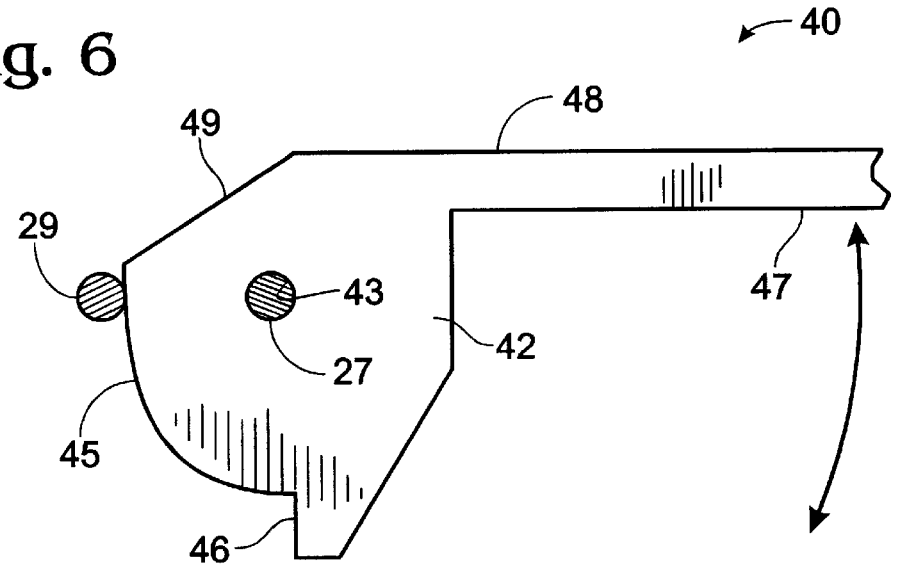
FIG. 6 is a fragmentary, side elevation view of one of the cam ears of the trigger plate of the invention, shown in the non-trolling mode.
Figure 7:
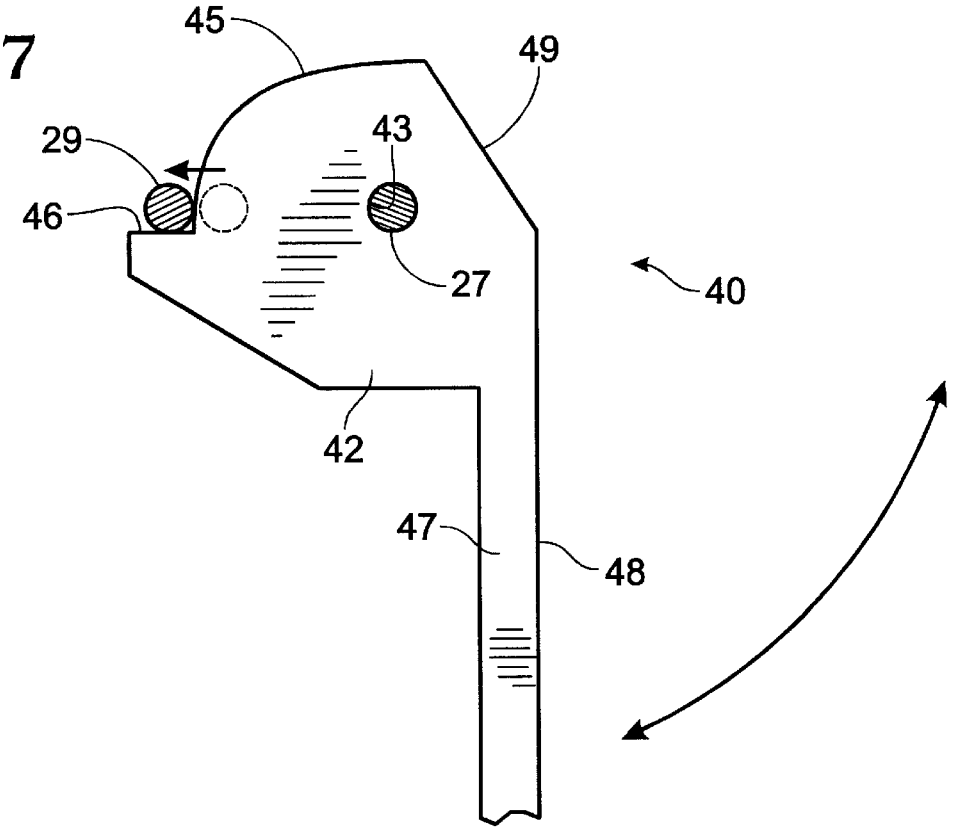
FIG. 7 is a fragmentary, side elevation view of one of the cam ears of the trigger plate of the invention, shown in the trolling mode.

The relationship of the cam ears 41 and 42 of trigger plate 40 to fixed axle 27 and locking rod 29 is best seen in FIGS. 6 and 7. Only left cam ear 42 of trigger plate 40 is shown, but right cam ear 41 is identical thereto, although the mirror image thereof.

The flattened portion 49 of the outer surface 45 of cam ears 41 and 42 prevents binding between frame plate 30 and trigger plate 40 during the transition between the non-trolling (horizontal) position and the trolling (vertical) position.

FIG. 6 illustrates trigger plate 40 in its substantially horizontal, non-trolling position. As can be seen, outer surface 45 of cam ear 42 is in contact with locking rod 29, but locking rod 29 is not seated in a recess in outer surface 45 as it is relative to locking ears 31 and 32 of frame plate 30. Thus, trigger plate 40 is somewhat free to rotate about fixed axle 27, and, at non-trolling speeds, droops down slightly away from frame plate 30 but is kept from drooping further toward the vertical both by the action of locking rod 29 acting against outer surface 45 and by the flow of water acting against the inner planar surface 47 of trigger plate 40. If desired, trigger plate 40 can be latched to frame plate 30 by latch 80, as will be discussed below.

FIG. 7 illustrates trigger plate 40 in its substantially vertical, trolling position. As can be seen, cam ear 42 has rotated approximately 90 degrees so that the face of trolling notch 46 located in outer surface 45 has come into contact with locking rod 29, thereby preventing further rotation.

Cam ears 41 and 42 of trigger plate 40 each have a first radius extending from its intersection with axle 27 to its outer surface 45 at its non-trolling contact position with locking rod 29 (as seen in FIG. 6) and a second radius extending from its intersection with axle 27 to its outer surface 45 located at trolling notch 46 (as seen in FIG. 7), the second radius being larger than the first radius.

Returning now to FIGS. 1–3, it can be seen that the tension in heavy duty springs 50 and 52 extending between frame plate 30 and mounting bracket 20 constantly urge frame plate 30 to rotate clockwise (as illustrated) around fixed axle 27 from a substantially horizontal position to the substantially vertical position shown, in which position the major planar surfaces 37 and 38 of frame plate 30 are substantially perpendicular to plane of plate 21 and the planes of flanges 23 and 24 of mounting bracket 20.

Figure 2:
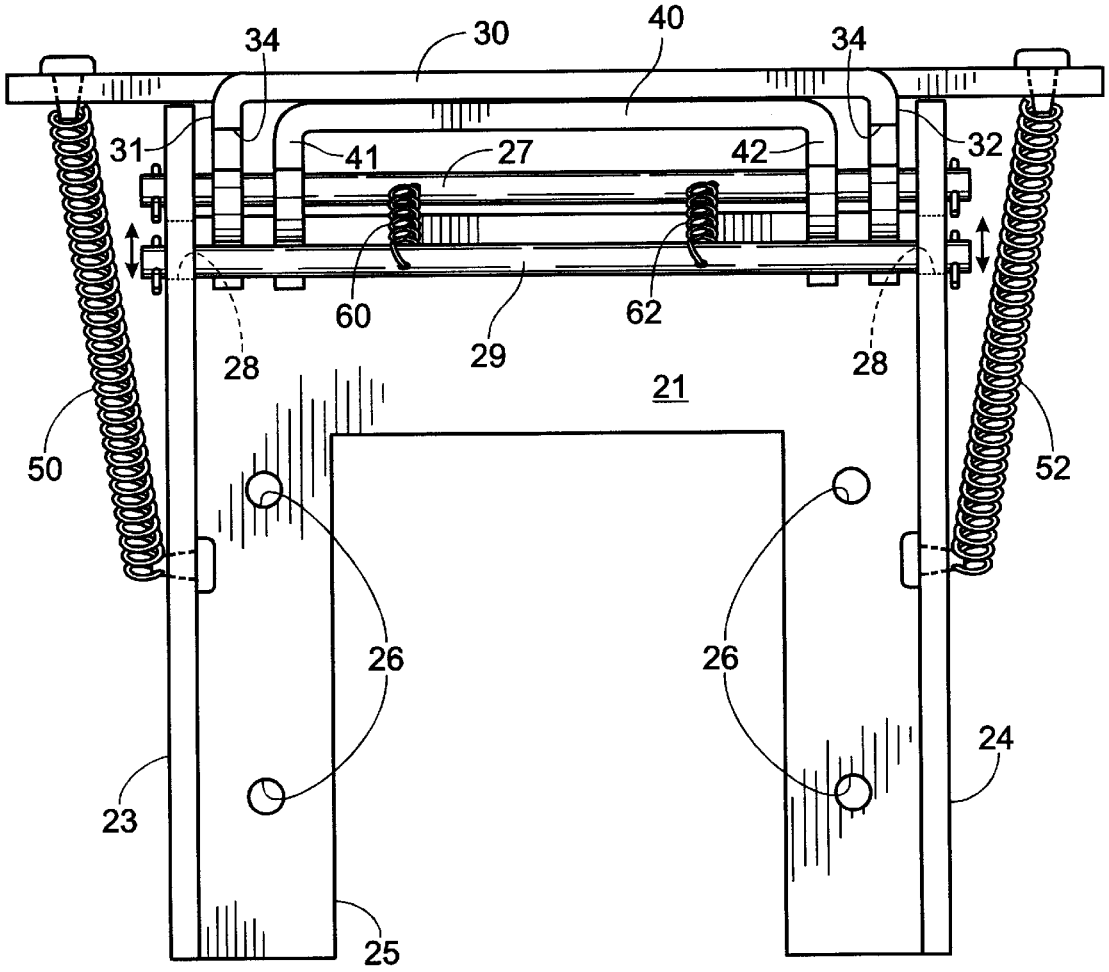
FIG. 2 is a top view of the trolling plate assembly of the present invention with the frame and trigger plates deployed in the trolling position.

Locking springs 60 and 62 extend between fixed axle 27 and locking rod 29, as seen in FIG. 2. Locking springs 60 and 62 urge movable locking rod 29 toward fixed axle 27, and against the outer surfaces 35 of notched cam ears 31 and 32 of frame plate 30, and against the outer surfaces 45 of notched cam ears 41 and 42 of trigger plate 40. Thus, locking rod 29 acts as a cam follower as cam ears 31, 32, 41, and 42 rotate about fixed axle 27. The outer ends of locking rod 29 extend through slots 28 located in flanges 23 and 24, and can be prevented from moving out of slots 28 by any suitable means, such as cotter pins located in both ends thereof. Slots 28 are sized to permit forward and backward movement of locking rod 29, in the direction of the arrows shown in FIG. 2.

Figure 9:
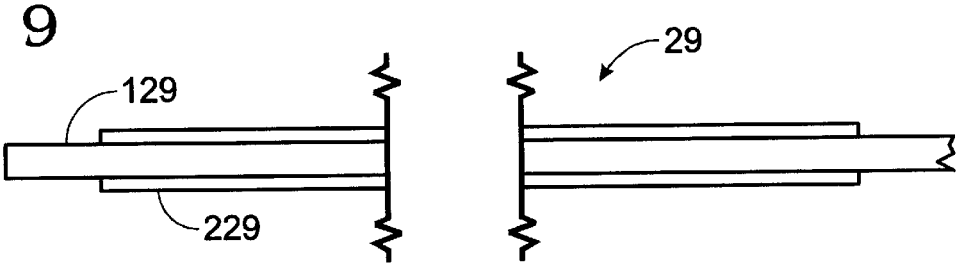
FIG. 9 is a cross-sectional view of the locking rod.

In order to facilitate motion of cam ears 31, 32, 41, and 42 about locking rod 29, it may be configured as shown in FIG. 9 wherein locking rod 29 is comprised of an inner rod 129 having an outer cylindrical sleeve 229 rotatably located thereon. With the configuration shown in FIG. 9, the motion of cam ears 31, 32, 41, and 42 against locking rod 29 causes outer sleeve 229 to rotate around inner rod 129.

Figure 3:
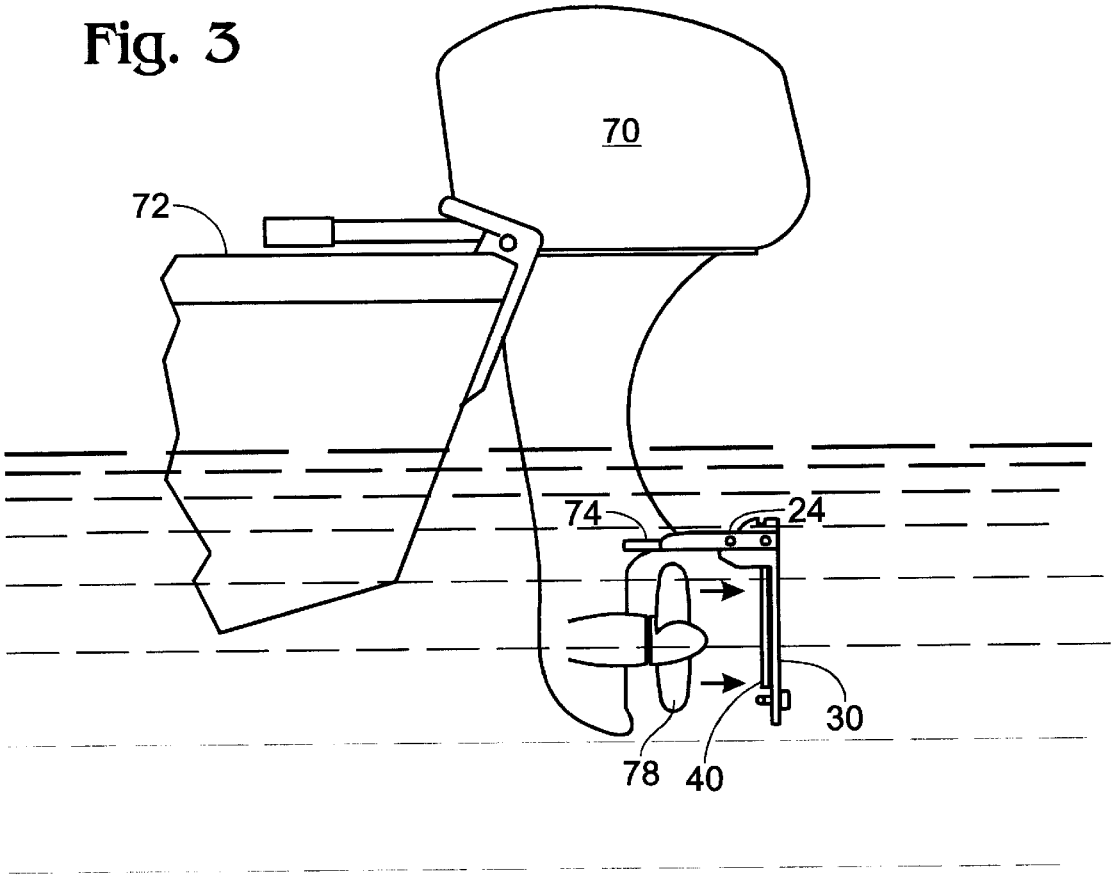
FIG. 3 is a schematic view of the trolling plate assembly (shown in the trolling position) mounted on the anticavitation plate of a boat's motor.

FIG. 3 illustrates the trolling plate assembly 10 of the invention attached to the motor 70 of a boat 72. Trolling plate assembly 10 is shown in its trolling position, i.e., with frame plate 30 and trigger plate 40 vertically disposed. As can be seen, trolling plate assembly 10 is attached to the anticavitation plate 74 of motor 70 by means of suitable fastening members (not shown) extending through openings 26 in mounting bracket 20. In the trolling position shown in FIG. 3, frame plate 30 and trigger plate 40 are positioned below the waterline and rearward of propeller 78. Frame plate 30 cannot swivel closer to propeller 78 since locking rod 29 is in abutment with notches 36 of cam ears 31 and 32. Similarly, trigger plate 40 cannot swivel closer to propeller 78 since locking rod 29 is in abutment with notches 46 of cam ears 41 and 42. Heavy duty springs 50 and 52 hold frame plate 30 in the trolling position shown in FIG. 3. Since trigger plate 40 abuts against frame plate 30, it is also held in the vertical trolling position shown in FIG. 3.

The operation of the trigger plate assembly of the invention will now be discussed.

Figure 8:
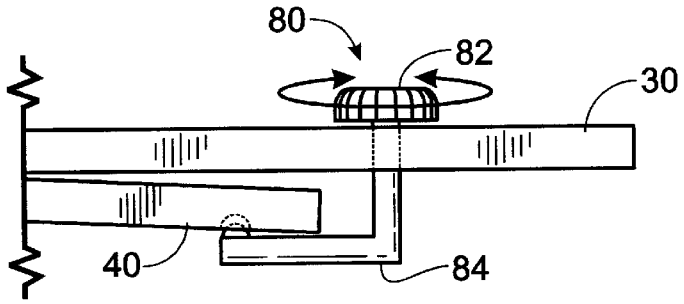
FIG. 8 is a fragmentary, side elevation view of a plate locking mechanism of the invention.

Upon initial unloading of the boat into water, trigger plate 40 can be held firmly against frame plate 30 in a substantially horizontal, non-trolling position by means of a rotatable locking mechanism 80 having a knob 82 and "L" shaped arm 84, as best seen in FIG. 8. This allows better boat operation while maneuvering in a reverse direction around docks and obstacles. Upon the initial forward movement of the boat locking mechanism 80 is forced out of engagement by virtue of water pressure thereby releasing trigger plate 40 so that it is free to rotate about fixed axle 27. Although trigger plate 40 is free to rotate about fixed axle 27, it does not rotate very far from the horizontal in the non-trolling position by virtue of locking rod 29 being urged against the outer surfaces 45 of cam ears 41 and 42 (as seen relative to cam ear 42 in FIG. 6). Frame plate 30 is retained in a substantially horizontal position by the action of locking rod 29 seated in non-trolling recesses 34 of cam ears 31 and 32.

When it is desired to go from a non-trolling mode to a trolling mode, the boat is brought to a stop and the motor placed in reverse. As the boat backs up, the pressure of water pushing against outer (rearward) planar surface 48 of trigger plate 40 (which droops down sufficiently from the horizontal to allow the pressure of the water to act against it) forces it to rotate toward a vertical position. As trigger plate 40 rotates toward a vertical position, the outer surfaces 45 of cam ears 41 and 42 are configured to push locking rod 29 forward and out of engagement with recesses 34 of cam ears 31 and 32 of frame plate 30. As locking rod 29 disengages from its seat in non-trolling recesses 34 of cam ears 31 and 32, frame plate 30 becomes free to rotate around fixed axle 27 from its horizontal position to a vertical position. Heavy duty springs 50 and 52 pull frame plate 30 downwardly toward a vertical, trolling position. As frame plate 30 comes into contact with trigger plate 40 it pushes trigger plate 40 downwardly with it.

As frame plate 30 approaches a vertical, trolling position, locking rod 29 contacts the face of notches 36 in cam ears 31 and 32, and further rotation of frame plate 30 toward propeller 78 ceases. Similarly, the faces of notches 44 of cam ears 41 and 42 contact locking rod 29 and further rotation of trigger plate 40 toward propeller 78 ceases. The frame plate 30 and trigger plate 40 are now in a substantially vertical position in abutment with each another, and, by virtue of their position relative to propeller 78, slow down the forward motion of the boat to a suitable trolling speed.

When it is desired to go from a trolling mode to a non-trolling mode, the boat operator merely increases the speed of the boat. As the forward motion of the boat increases, water pushing against the forward planar face 47 of trigger plate 40 and the forward planar face 37 of frame plate 30 overcome the downward pull of heavy duty springs 50 and 52 and force both plates to rotate from a substantially vertical position into a substantially horizontal position. As frame plate 30 approaches a substantially horizontal, non-trolling position, locking rod 29 once again engages recesses 34 of cam ears 31 and 32, and locks frame plate 30 into a substantially horizontal position.

Thus, the present invention allows a boat operator to move plates 30 and 40 back and forth between a non-trolling and a trolling position by merely changing the direction of his boat. The operator cannot damage or destroy the trolling plate assembly because he or she forgot to manually actuate a trolling plate unlocking mechanism.

Although the preferred embodiment of the invention has been described, modifications may be made thereto without departing from the scope of the invention claimed herein.

The invention claimed is:

1. A trolling plate assembly comprising:

a mounting bracket adapted to be mounted on a boat motor, said mounting bracket having a plate member with flanges extending perpendicularly from longitudinal edges of said plate member;

a fixed axle extending between said flanges;

a movable locking rod extending between said flanges in a position spaced forward of said fixed axle and parallel thereto;

at least one locking spring connected at one end to said fixed axle and at its other end to said movable locking rod and adapted to urge said movable locking rod toward said fixed axle;

a frame plate having a major planar surface, at least two cam ears located at one end of said frame plate and extending substantially perpendicular to said major planar surface, said cam ears being pivotally mounted on said fixed axle, said cam ears having an outer surface in compressive contact with said movable locking rod, said cam ears having a non-trolling recess adapted to receive said movable locking rod in a non-trolling position of said frame plate and a trolling notch adapted to receive said movable locking rod in a trolling position of said frame plate;

a trigger plate located forward of said frame plate, said trigger plate having a major planar surface, at least two cam ears located at one end of said trigger plate, said cam ears being pivotally mounted on said fixed axle, said cam ears having an outer surface in compressive contact with said movable locking rod, said cam ears having a trolling notch adapted to receive said movable locking rod in a trolling position of said trigger plate; and at least one trolling spring attached at one end to said frame plate and at its other end to said mounting bracket and adapted to provide a pulling force to said frame plate urging it to pivot downward around said fixed axle into a position substantially perpendicular to said mounting plate.

2. The trolling plate of claim 1 wherein said trolling plate has two cam ears, one cam ear being located on one side of said trigger plate and the other cam ear being located on the other side of said trigger plate.

3. The trolling plate of claim 2 having two locking springs, said locking springs being positioned between said two cam ears of said trigger plate.

4. The trolling plate of claim 1 having first and second trolling springs, said first trolling spring being attached to one side of said frame plate and said second trolling spring being attached to the other side of said frame plate.

5. The trolling plate of claim 1 wherein said locking rod is comprised of an inner rod and a tubular outer rod rotatably located on said inner rod.

6. The trolling plate of claim 1 wherein said frame plate has two cam ears, one being located on one side of said frame plate and the other being located on the other side of said frame plate.

7. The trolling plate of claim 6 wherein said cam ears of said trigger plate are located between said cam ears of said frame plate.

8. The trolling plate of claim 1 wherein said cam ears of said trigger plate each have a first radius extending from said axle to its outer surface at the non-trolling position and a second radius extending from said axle to its outer surface at the trolling position, said second radius being larger than said first radius, whereby when said cam ears of said trigger plate are rotated from the non-trolling position to the trolling position, said outer surface of said cam ears of said trigger plate forces said locking rod away from said axle a distance sufficient to remove said locking rod from said non-trolling recess located in the cam ears of said frame plate.

9. The trolling plate of claim 1 including a locking means for securing said trigger plate to said frame plate.

* * * * *